US009048082B2

(12) United States Patent
Furuhashi

(10) Patent No.: US 9,048,082 B2
(45) Date of Patent: Jun. 2, 2015

(54) TIME-OF-FLIGHT MASS SPECTROMETER

(75) Inventor: Osamu Furuhashi, Uji (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/349,243

(22) PCT Filed: Jul. 25, 2012

(86) PCT No.: PCT/JP2012/068772

§ 371 (c)(1),
(2), (4) Date: Apr. 15, 2014

(87) PCT Pub. No.: WO2013/051321

PCT Pub. Date: Apr. 11, 2013

(65) Prior Publication Data

US 2014/0224982 A1 Aug. 14, 2014

(30) Foreign Application Priority Data

Oct. 3, 2011 (JP) ..... 2011-218913

(51) Int. Cl.
*H01J 49/40* (2006.01)

(52) U.S. Cl.
CPC ..... *H01J 49/403* (2013.01)

(58) Field of Classification Search
CPC ..... H01J 49/00; H01J 49/06; H01J 49/061; H01J 49/26; H01J 49/34; H01J 49/40; H01J 49/461; H01J 49/403; H01J 49/405; H01J 49/406
USPC ..... 250/281, 282, 283, 286, 287, 288
See application file for complete search history.

(56) References Cited

U.S. PATENT DOCUMENTS

| | | | | |
|---|---|---|---|---|
| 6,469,296 | B1 | 10/2002 | Hansen et al. | |
| 6,903,332 | B2 | 6/2005 | Weiss et al. | |
| 2004/0159782 | A1 * | 8/2004 | Park | 250/282 |
| 2007/0194223 | A1 | 8/2007 | Sato et al. | |
| 2009/0212208 | A1 | 8/2009 | Sato et al. | |

FOREIGN PATENT DOCUMENTS

| | | | |
|---|---|---|---|
| DE | 11 2005 001 175 | T5 | 4/2007 |
| JP | 2006-012782 | A | 1/2006 |
| WO | 2005/114702 | A1 | 12/2005 |

OTHER PUBLICATIONS

Robert J. Cotter, "Time-of-Flight Mass Spectrometry: Instrumentation and Applications in Biological Research", American Chemical Society, 1997, 36 pages.

(Continued)

*Primary Examiner* — Nicole Ippolito
(74) *Attorney, Agent, or Firm* — Sughrue Mion, PLLC

(57) ABSTRACT

A thin metal plate and two prismatic-bar-shaped metal members that are parallel to each other are alternately and repeatedly stacked, and the stack is sandwiched between two thick metal plates. Each contact surface is bonded to the counterpart surface by diffusion bonding to form an integrated multilayer body. The multilayer body is cut at predetermined intervals at planes perpendicular to the thin metal plates, whereby a grid-like electrode is completed, with the thin metal plates serving as crosspieces and the metal members serving as spacers for defining a gap which serves as openings.

20 Claims, 9 Drawing Sheets

(56) References Cited

OTHER PUBLICATIONS

David S. Selby, et al., "Reducing grid dispersion of ions in orthogonal acceleration time-of flight mass spectrometry: advantage of grids with rectangular repeat cells", International Journal of Mass Spectrometry, 2001, pp. 201-210, vol. 206.

M. Guilhaus, et al., "Orthogonal Acceleration Time-Of-Flight Mass Spectrometry", Mass Spectrometry Review, 2000, pp. 65-107, vol. 19.

"Ion Optical Grids for Applications in Time-of-Flight Mass Spectrometry", ETP, [Searched on Sep. 16, 2011], Internet URL:http://www.sge.com/uploads/0e/45/0e453a8d8744bec8a4f2a986878b8d6a/PD-0251-A.pdf, 2 pages.

* cited by examiner (a)

(b)

TIME-OF-FLIGHT MASS SPECTROMETER

CROSS REFERENCE TO RELATED APPLICATIONS

This application is a National Stage of International Application No. PCT/JP2012/068772 filed Jul. 25, 2012, claiming priority based on Japanese Patent Application No. 2011-218913 filed Oct. 3, 2011, the contents of all which are incorporated herein by reference in their entirety.

TECHNICAL FIELD

The present invention relates to a time-of-flight mass spectrometer (which is hereinafter abbreviated as "TOFMS"), and more specifically, to a grid-like electrode which is used to allow ions to pass through while accelerating or decelerating those ions in a TOFMS.

BACKGROUND ART

In the TOFMS, a preset amount of kinetic energy is imparted to ions originating from a sample component to make them fly a preset distance in a space. The period of time required for this flight is measured, and the mass-to-charge ratios of the ions are determined from their respective times of flight. Therefore, when the ions are accelerated and begin to fly, if the ions vary in the position and/or the amount of initial energy, a variation arises in the time of flight of the ions having the same mass-to-charge ratio, which leads to a deterioration in the mass-resolving power or mass accuracy. One commonly known solution to this problem is an orthogonal acceleration TOFMS (which is also called a perpendicular acceleration or orthogonal extraction TOFMS), in which ions are accelerated and sent into the flight space in a direction orthogonal to the incident direction of the ion beam (for example, see Non-Patent Document 1 or 3).

FIG. 11(*a*) is a schematic configuration diagram of a typical orthogonal acceleration TOFMS, and FIG. 11(*b*) is a potential distribution diagram along the central axis of the ion flight. Ions which have been generated in an ion source (not shown) are given an initial velocity in the X-axis direction and introduced into an orthogonal accelerator section 1. In this section, a pulsed electric field is applied between a push-out electrode 11 and each of the grid-like electrodes 12 and 13, whereby the ions are ejected in the Z-axis direction and begin to fly in a field-free flight space 2A inside a TOF mass separator 2. In the reflecting region 2B, where a rising potential gradient is formed, the ions are made to reverse their direction and travel backward, to eventually arrive at and be detected by a detector 3.

To suppress a deterioration in the mass-resolving power due to a spatial spread of the ions in the orthogonal accelerator section 1, the system is typically tuned so that an ion packet (a collection of ions) ejected from the orthogonal accelerator section 1 is transiently focused on a focusing plane 21 located in the field-free flight space 2A, and subsequently, the dispersed ion packet is once more focused on the detection surface of the detector 3 by the reflecting region 2B. To achieve such a focusing, the orthogonal accelerator section 1 may be either a dual-stage type in which two uniform electric fields are created with two grid-like electrodes 12 and 13 (as shown in FIG. 11(*a*)) or a single-stage type in which a single uniform electric field is created with one grid-like electrode. Similarly, the reflecting electric field created with the grid-like electrodes 22 and 23 may also be a dual-stage type with two uniform electric fields or a single-stage type with one uniform electric field. In any of these cases, what is necessary is to adjust the strengths of a plurality of uniform electric fields so as to make the ion packet focused on the detection surface of the detector 3. A theory for realizing such a focusing condition is described in detail in Non-Patent Document 1.

As described previously, in the orthogonal acceleration TOFMS, a grid-like electrode made of a conductive material is widely used to create the orthogonal acceleration electric field or the reflecting electric field. The "grid-like" structures in the present description include both a structure in which thin members are meshed in both horizontal and vertical directions in a grid-like (cross-ruled) pattern and a structure in which thin members are arranged at regular intervals (which are typically, but not necessarily, parallel to each other). An electrode having the former structure is often simply called a grid electrode, while an electrode having the latter structure may be called a parallel-grid electrode for the sake of distinction from the former type.

FIG. 12 is a partially-sectioned perspective view of one example of the conventionally used grid-like electrodes. This grid-like electrode 200 has a structure with crosspieces 201 of width W and thickness T aligned in parallel at intervals P. The opening 202 between the two neighboring crosspieces 201 has a width (smaller dimension) of P-W and a length (larger dimension) of L. The depth of the opening 202 is equal to the thickness T of the crosspieces 201.

In the case where there is a difference in the electric-field strength between the entrance side and the exit side (upper and lower sides in FIG. 12) of the grid-like electrode 200, if the width P-W of the opening 202 is excessively large, a noticeable dispersion of the beam occurs due to the penetration of the electric field through the opening 202 or the lens effect. Therefore, the width P-W of the opening 202 should be as small as possible. On the other hand, the transmission efficiency of the ions through the grid-like electrode 200 having the previously described structure is geometrically given by the ratio of the width of the opening 202 to the interval of the crosspieces 201, i.e. (P-W)/P. Accordingly, given the same interval P of the crosspieces 201, the ion transmission efficiency increases with a decrease in the width W of the crosspiece 201. To realize an ideal grid-like electrode which can achieve a high ion transmission efficiency and with low dispersion of the ion beam, the interval P and the width W of the crosspieces 201 should preferably be as small as possible. However, as will be explained later, those sizes have lower limits associated with the mechanical strength or manufacture feasibility.

Fine-grid electrodes for TOFMS manufactured using the technique of electroforming have been developed to achieve a high ion transmission efficiency while minimizing the interval P of the crosspieces 201. For example, Non-Patent Documents 2 and 3 disclose a grid-like nickel (Ni) electrode produced by electroforming, which measures 83 μm in the interval P of the crosspieces, approximately 25 μm in the width W of the crosspieces, and approximately 10 μm in the thickness T of the crosspieces. According to those documents, its ion transmission efficiency is approximately 70 to 80%. An example of commercially available grid-like electrodes is a product disclosed in Non-Patent Document 4. This product, which consists of tungsten wires with a diameter of 18 μm tensioned at intervals of 250 μm, has achieved a high ion transmission efficiency of 92%.

However, the conventional fine-grid electrodes which have been realized by electroforming, thin-wire tensioning or other techniques in the previously described manner are comparatively low in mechanical strength and hence have a problem as follows:

A dispersion in the initial kinetic energy of the ions in the Z-axis direction within the orthogonal accelerator section 1 causes a decrease in the mass-resolving power of the TOFMS. A turnaround time $T_A$ [i.e. the time-of-flight difference between two ions having the same initial position and the same initial kinetic energy, one ion moving in the same direction as the ion-extracting direction (i.e. in the positive direction of the Z-axis) and the other ion in the opposite direction (i.e. in the negative direction of the Z-axis)], is calculated by the following equation (1):

$$T_A \propto \sqrt{(mE)}/F \quad (1)$$

where F is the strength of the ion-extracting electric field in the orthogonal accelerator section 1, E is the initial kinetic energy of each ion, and m is the mass of each ion. This equation (1) suggests that strengthening the electric field in the orthogonal accelerator section 1 is effective for reducing the turnaround time $T_A$. As one example, FIG. 13 shows the result of a calculation of the relationship between the extracting electric field and the turnaround time $T_A$ for an ion of m/z 1000 in a thermal motion (E=30 meV). For example, the result shows that, if the turnaround time $T_A$ must be reduced to 1 [ns] (1.0E-09s) or less to achieve a high mass-resolving power in the TOFMS, an electric field stronger than 1500 [V/mm] is required.

Strengthening the electric field in the orthogonal accelerator section in this manner increases the difference in the electric-field strength between the ion entrance side and the exit side of the grid-like electrode and thereby causes a strong force to act on the crosspieces of the grid-like structure. This force acting on the crosspieces increases as the electric field is made stronger to further reduce the turnaround time. For example, a calculation shows that the force acting on the grid-like electrode per unit area under an electric-field strength of 1500 [V/mm] is as high as 10 [N/m$^2$]. According to a study by the present inventor, Currently known grid-like electrodes having the previously described structures can hardly bear such a force. For example, if a grid-like electrode made of nickel (Young's modulus=200 GPa) measuring W=20 μm, T=10 μm and L=30 mm and having an ion transmission efficiency of 80% is tested as a both-ends-fixed beam with a uniformly distributed load, the displacement in its central portion is estimated at approximately 6 mm, in which situation the crosspieces in the grid-like structure will probably be easily broken. FIG. 14 shows the result of a calculation of the predicted amount of displacement in the central portion of the crosspiece for various thicknesses T of the crosspiece under the previously described conditions.

In the case of a structure in which thin wires are used as the crosspieces, the previously described breakage can be prevented by using thicker wires. However, the use of thicker wires increases the width W of the crosspieces and sacrifices the ion transmission efficiency. A possible idea for increasing the mechanical strength using thin wires instead of thick wires is to decrease the length L of the openings. However, this design also sacrifices the ion transmission efficiency. In the case of manufacturing the fine-grid electrode using electroforming, the thickness T of the electrode should not be substantially increased, since the manufacturing process includes the step of peeling off a thin metal plate from a mold. Therefore, it is difficult to increase the mechanical strength while maintaining the small width W of the crosspieces. Stacking a plurality of electroformed grid-like electrodes one on top of another with high positional accuracy and bonding them together to increase the mechanical strength might also be possible. However, this idea is impractical from technical points of view as well as in regards to the production cost.

Furthermore, if the difference in the electric-field strength between the ion entrance side and the ion exit side of the grid-like electrode is large, the electric field penetrates through the openings of the grid-like electrode and adversely affects the mass spectra even if the openings have a small width. For example, in the system shown in FIG. 11(*a*), when ions are to be introduced into the space between the push-out electrode 11 and the first grid-like electrode 12, both the push-out electrode 11 and the first grid-like electrode 12 are set at the ground potential, while the second grid-like electrode 13 is set at a higher potential for extraction and acceleration. In an ideal situation, the introduced ions undergo no force in the Z-axis direction and travel straight in the X-axis direction. When the introduced ions are to be ejected, a pulsed voltage is applied to both the push-out electrode 11 and the first grid-like electrode 12 to create an electric field, by which the ions are ejected into the TOF mass separator 2. However, the extracting and accelerating electric field created by the second grid-like electrode 13 actually leaks through the openings of the first grid-like electrode 12 into the orthogonal accelerator section 1 in the ion-introducing process. This electric field has the effect of accelerating the ions in the Z-axis direction and curving their trajectories before ejection, which results in a deterioration in the mass-resolving power. The leaking electric field also makes the introduced ions continuously flow into the field-free flight space 2A within the TOF mass separator 2 before ejection, causing an increase in the background signal in the mass spectrum.

To address this problem, a system disclosed in Patent Document 1 has an increased number of grid-like electrodes in the orthogonal accelerator section 1 to create a potential barrier which prevents ions from leaking into the field-free flight space 2A after the ions have been introduced in the space between the push-out electrode 11 and the grid-like electrode 12. In a system described in Patent Document 2, which does not use a grid-like electrode in the orthogonal accelerator section 1, a potential barrier similar to the one described in Patent Document 1 is created by switching a voltage applied to an aperture electrode placed between the ion-accelerating region and the field-free flight space, so as to prevent the leakage of ions from the ion-accelerating region into the field-free space. In the technique described in Patent Document 1, the increase in the number of grid-like electrodes leads to an increase in the production cost as well as a decrease in the ion transmission efficiency. The technique described in Patent Document 2 also makes the production cost higher since it requires an additional element for switching the voltage.

BACKGROUND ART DOCUMENT

Patent Document

Patent Document 1: US-B1 6469296
Patent Document 1: US-B1 6903332

Non-Patent Document

Non-Patent Document 1: R. J. Cotter, "*Time-of-Flight Mass Spectrometry: Instrumentation and Applications in Biological Research*", American Chemical Society, 1997

Non-Patent Document 2: David S. Selby et al., "Reducing grid dispersion of ions in orthogonal acceleration time-of-flight mass spectrometry: advantage of grids with rectangular repeat cells", *International Journal of Mass Spectrometry,* 206, 2001, pp. 201-210

Non-Patent Document 3: M. Guilhaus et al., "Orthogonal Acceleration Time-of-Flight MS", *Mass Spectrometry Review,* 19, 2000, pp. 65-107

Non-Patent Document 4: "Ion Optical Grids for Applications in Time-Of-Flight Mass Spectrometry", ETP, [Searched on Sep. 16, 2011], Internet

SUMMARY OF THE INVENTION

Problem to be Solved by the Invention

The present invention has been developed to solve the previously described problems, and one of its objectives is to provide a time-of-flight mass spectrometer in which the mechanical strength of a grid-like electrode used for accelerating or decelerating ions is improved without sacrificing the ion transmission efficiency, so as to allow for the use of a stronger electric field for accelerating ions in an orthogonal accelerator or other sections.

Another objective of the present invention is to provide a time-of-flight mass spectrometer in which the penetration of an electric field from the flight space into the ion-accelerating region through a grid-like electrode is prevented, while avoiding an increase in the production cost of the system or a decrease in the ion transmission efficiency, so as to suppress the curving of the trajectories of the ions before ejection from the ion-accelerating region as well as to prevent a leakage of the ions into the flight space.

Means for Solving the Problem

The first aspect of the present invention aimed at solving the previously described problems is a time-of-flight mass spectrometer in which ions are accelerated and introduced into a flight space, and in which the ions are detected after being separated according to their mass-to-charge ratios while flying in the flight space, the time-of-flight mass spectrometer having a grid-like electrode for creating an electric field for accelerating and/or decelerating the ions while allowing the ions to pass through, wherein:

the grid-like electrode is a structure having a thickness equal to or greater than two times the size of the smaller dimension of an opening of the grid-like electrode.

In the conventional and common grid-like electrodes, the thickness of the electrode, i.e. the depth of its openings, is smaller than the size of the smaller dimension of the openings. By contrast, the grid-like electrode used in the time-of-flight mass spectrometer according to the first aspect of the present invention has a thickness equal to or greater than two times the size of the smaller dimension of the openings. According to a study by the present inventor, if the thickness of the grid-like electrode and the size of the smaller dimension of the openings are chosen in the aforementioned manner, it is possible to substantially prevent an electric field created in a space on one side of the electrode from penetrating through the openings of the electrode into the space on the opposite side. The phrase "substantially prevent" means that the electrode can prevent the penetration of an electric field which has such a large magnitude of potential that affects the behavior of the ions present in the space on the opposite side.

The grid-like electrode characteristic of the first aspect of the present invention is particularly suitable for a time-of-flight mass spectrometer having an orthogonal accelerator section including the aforementioned grid-like electrode serving as a first grid-like electrode, together with an push-out electrode and a second grid-like electrode facing each other across the first grid-like electrode, where the three electrodes are arranged so that ions sequentially pass through the first and second grid-like electrodes to be ejected from the orthogonal accelerator section into the flight space.

In the time-of-flight mass spectrometer having this configuration, the space between the push-out electrode and the first grid-like electrode is made to be a field-free space, and the ions to be analyzed are introduced into this field-free space while an electric field for moving the ions from the first grid-like electrode toward the second grid-like electrode is present in the space between the first grid-like electrode and the second grid-like electrode. In this situation, the first grid-like electrode is sandwiched between the space with no electric field and the space in which a strong electric field is present. However, as explained previously, no leakage of the potential due to the electric field through the first grid-like electrode occurs, so that the introduced ions do not undergo any influence from the electric field created in the space between the first and second grid-like electrodes. Therefore, the ions before ejection do not leak through the openings of the first grid-like electrode. Additionally, the deflection of the ion trajectories before ejection does not occur.

The first mode of the second aspect of the present invention aimed at solving the previously described problems is a time-of-flight mass spectrometer in which ions are accelerated and introduced into a flight space, and in which the ions are detected after being separated according to their mass-to-charge ratios while flying in the flight space, the time-of-flight mass spectrometer having a grid-like electrode for creating an electric field for accelerating and/or decelerating the ions while allowing the ions to pass through, wherein:

the grid-like electrode is a grid-like structure created by stacking a plurality of electrically conductive thin plates, with electrically conductive spacer members placed in between, to form an integrated body and by cutting this body at each of a plurality of planes orthogonal to the electrically conductive thin plates and arranged at predetermined intervals, the grid-like structure having openings whose width corresponds to the thickness of the electrically conductive spacer members and crosspieces whose width corresponds to the thickness of the electrically conductive thin plates, the crosspieces having a thickness corresponding to the interval of the cutting.

In the case of a conventional grid-like electrode manufactured by electroforming or wire-tensioning, it is impossible to increase its mechanical strength by increasing the thickness of the crosspieces while maintaining the interval and the width of the crosspieces small. By contrast, in the case of the grid-like electrode used in the time-of-flight mass spectrometer according to the second aspect of the present invention, the interval of the two neighboring crosspieces and the width of each crosspiece are determined by the thickness of the electrically conductive thin plate, which is typically a thin metal plate made of stainless steel or similar materials. Thin metal plates with various thicknesses from 10 μm to 100 μm are comparatively easy to procure, and the interval of the two neighboring crosspieces and the width of each crosspiece can also be chosen within that range. On the other hand, the thickness of the crosspieces is determined by the spatial interval at which a multilayer structure of the electrically conductive thin plates is cut. Therefore, the crosspieces can be given a sufficient thickness for achieving a desired level of mechanical strength regardless of the interval and width of the crosspieces. Thus, it is possible to increase the mechanical strength by increasing the thickness of the crosspieces while specifying the interval and width of the crosspieces primarily from the viewpoint of the ion transmission efficiency.

In the process of manufacturing the grid-like electrode used in the time-of-flight mass spectrometer according to the second aspect of the present invention, when a plurality of electrically conductive thin plates are stacked to form an integrated body with electrically conductive spacer members placed in between to ensure a predetermined gap, any method can be used for the surface-to-surface bonding of the electrically conductive thin plate and the electrically conductive spacer member as long as an adequate electrical conductivity can thereby be ensured. However, in terms of the device performance, it is undesirable to depart from a design tolerance due to an increase in the interval of the crosspieces caused by a rough bond surface. A preferable technique for bonding the electrically conductive thin plate and the electrically conductive spacer member is diffusion bonding, a suitable technique for the high-quality bonding of the surfaces. The cutting of a multilayer body obtained by such a bonding method can preferably be achieved using a wire electric discharge process since this technique applies only a minor force on the thin plates during the cutting and can yield a clean-cut surface.

Increasing the thickness of the crosspieces has the effects of improving the mechanical strength and suppressing the penetration of the electric field through the openings. However, it also increases the distance which the ions arriving at the grid-like electrode must travel in passing through the electrode. While an ion traveling in the direction orthogonal to the plane of the openings of the grid-like electrode can certainly pass through the electrode, an ion travelling obliquely at a certain angle to the orthogonal direction is more likely to be annihilated due to collision with a wall surface parallel to the thickness direction of the crosspieces. Accordingly, if the ions vary considerably in the incident direction, the ion transmission efficiency will be low. To avoid this situation, the grid-like electrode in the second aspect of the present invention should preferably be used under the condition that there is only a minor variation in the incident direction of the ions.

One configuration for satisfying such a condition is an orthogonal acceleration time-of-flight mass spectrometer having an orthogonal accelerator section including a push-out electrode and the aforementioned grid-like electrode in order to initially accelerate ions. In this type of time-of-flight mass spectrometer, the variation in the incident direction of the ions before passing through the grid-like electrode is small. Therefore, even if the crosspieces are thick, the ions can easily pass through the space between the two neighboring crosspieces, so that a high ion transmission efficiency will be achieved.

In the process of manufacturing a multilayer body from a plurality of electrically conductive thin plates and electrically conductive spacer members, it is possible to use electrically conductive thin plates in the form of a rectangle or parallelogram with one pair of the parallel sides being adequately smaller in size than the other pair. In this case, the cutting process can be omitted and the multilayer body can directly be used as the grid-like electrode.

Thus, the second mode of the time-of-flight mass spectrometer according to the second aspect of the present invention is a time-of-flight mass spectrometer in which ions are accelerated and introduced into a flight space, and in which the ions are detected after being separated according to their mass-to-charge ratios while flying in the flight space, the time-of-flight mass spectrometer having a grid-like electrode for creating an electric field for accelerating and/or decelerating the ions while allowing the ions to pass through, wherein:

the grid-like electrode is a grid-like structure created by stacking a plurality of electrically conductive thin plates, with electrically conductive spacer members placed in between, to form an integrated body, the grid-like structure having openings whose width corresponds to the thickness of the electrically conductive spacer members and crosspieces whose width corresponds to the thickness of the electrically conductive thin plates, the crosspieces having a thickness corresponding to the size of one side of the electrically conductive thin plates.

EFFECT OF THE INVENTION

In the time-of-flight mass spectrometer according to the first aspect of the present invention, while ions to be analyzed are being introduced into the ion-accelerating region, the influence of the electric field from the flight space through the grid-like electrode is blocked, whereby the curving of the trajectories of the ions introduced into the ion-accelerating region is suppressed and a high mass-resolving power is ensured. A leakage of the ions into the flight space is also prevented, which is effective for suppressing a background noise due to such ions. Unlike the conventional techniques, it is unnecessary to increase the number of grid-like electrodes or provide a system for switching a voltage applied to an aperture electrode so as to block the penetration of the electric field. This is advantageous for suppressing the production cost. Naturally, the increased thickness gives the grid-like electrode a higher mechanical strength and prevents its breakage or other problems.

In the time-of-flight mass spectrometer according to the second aspect of the present invention, the mechanical strength of a grid-like electrode for creating, for example, an accelerating or decelerating electric field can be improved while maintaining high levels of ion transmission efficiency. Therefore, it is possible to increase the difference in the electric-field strength between the spaces on both sides of the grid-like electrode so as to reduce the turnaround time of the ions in the initial ion-accelerating section and thereby improve the mass-resolving power. It is also possible to increase the thickness of the crosspieces in the grid-like electrode to reduce the penetration of the electric field through the openings of the electrode. With this design, the electric field in a space in which ions are made to fly becomes closer to the ideal (field-free) state, and the deviation of the focusing characteristics of the mass spectrometer from the theoretical design becomes smaller, which leads to an improvement in the mass-resolving power.

In particular, the first mode of the time-of-flight mass spectrometer according to the second aspect of the present invention is advantageous for reducing the manufacturing cost per grid-like electrode, since a number of grid-like electrodes can be obtained by cutting a multilayer body created by stacking electrically conductive thin plates and electrically conductive spacer members.

MODE FOR CARRYING OUT THE INVENTION

Figure 1:
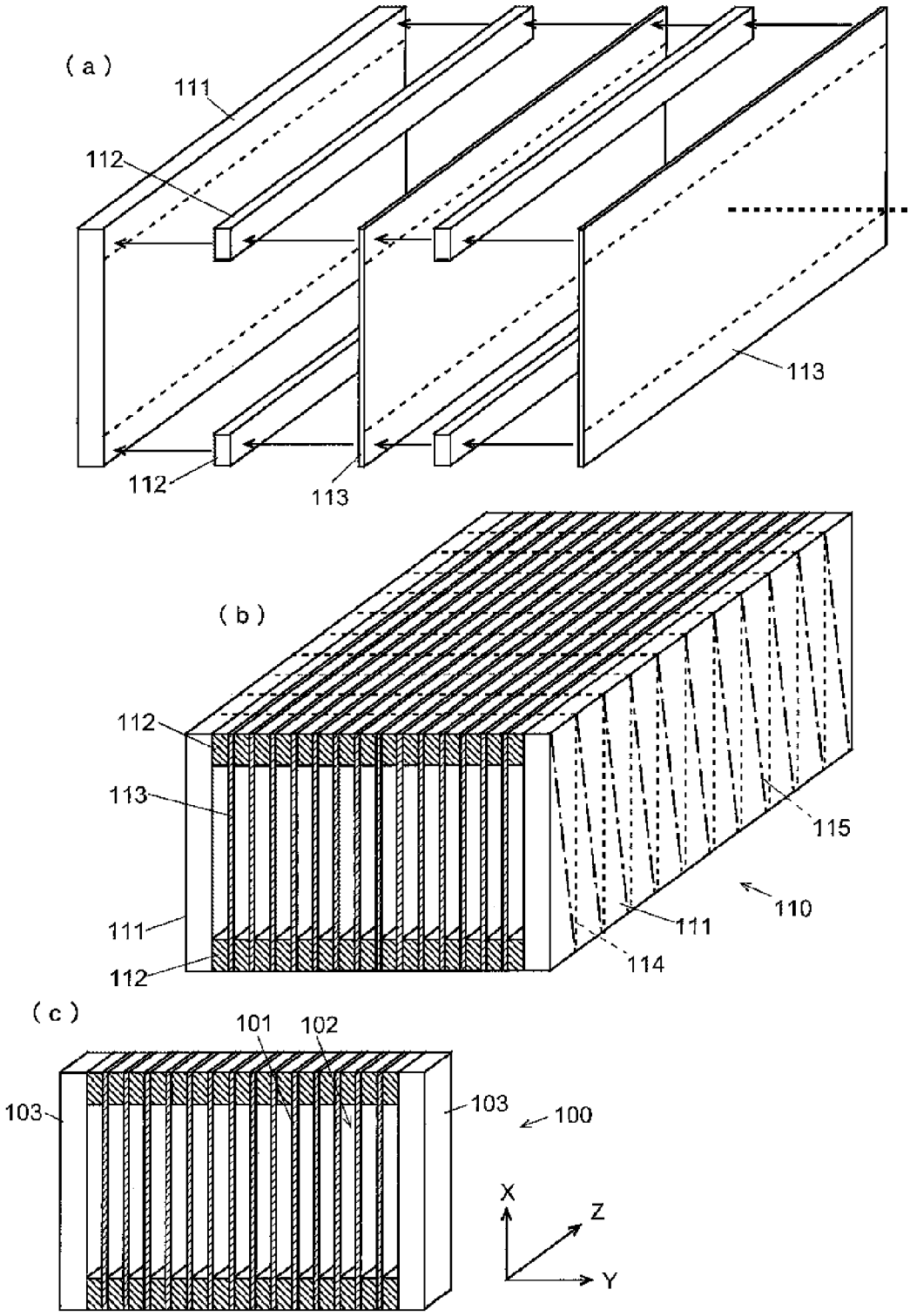
FIG. 1 is a diagram showing a procedure of manufacturing a grid-like electrode used in an orthogonal acceleration TOFMS which is one embodiment of the present invention, and an external perspective view of the grid-like electrode.
Figure 2:
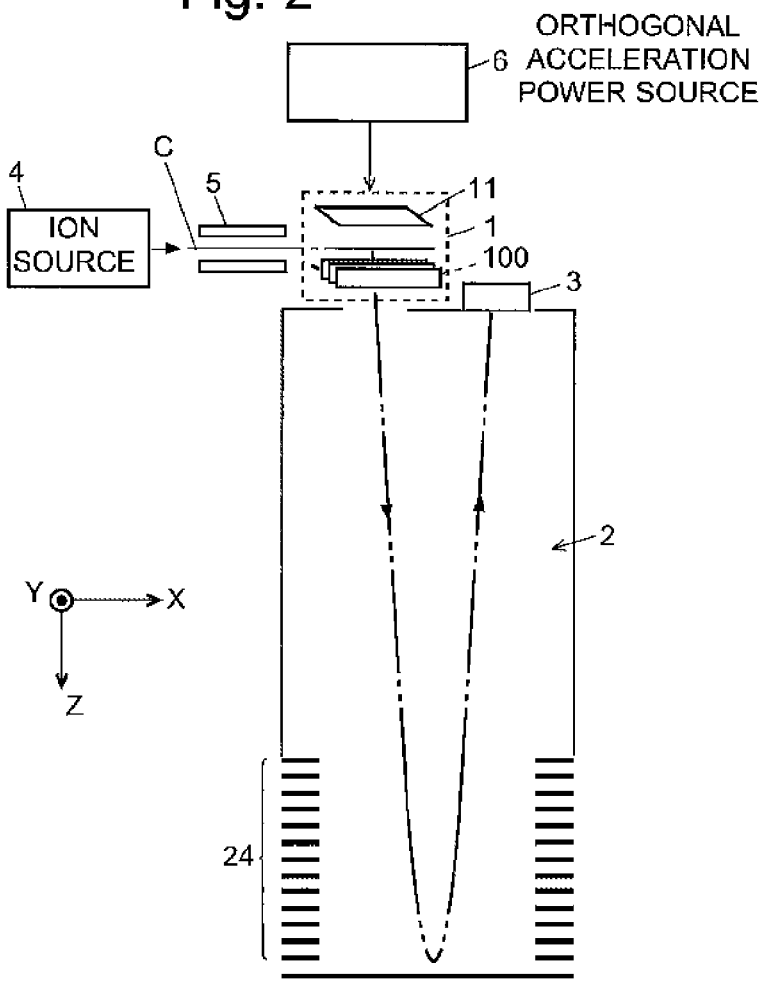
FIG. 2 is an overall configuration diagram of the orthogonal acceleration TOFMS of the present embodiment.

An orthogonal acceleration TOFMS as one embodiment of the present invention is hereinafter described with reference to the attached drawings. FIG. 2 is an overall configuration diagram of the orthogonal acceleration TOFMS of the present embodiment. FIG. 1 is an illustration showing the procedure of manufacturing a grid-like electrode 100 used in the orthogonal acceleration TOFMS of the present embodiment as well as an external perspective view of the electrode 100.

The orthogonal acceleration TOFMS according to the present embodiment includes: an ion source 4 for ionizing a target sample; an ion transport optical system 5 for sending ions into an orthogonal accelerator section 1; the orthogonal accelerator section 1 for accelerating and sending ions into a TOF mass separator 2; the TOF mass spectrometer 2 having a reflectron 24; a detector 3 for detecting ions which have completed their flight in the flight space of the TOF mass separator 2; and an orthogonal acceleration power source 6 for applying predetermined voltages to an push-out electrode 11 and a grid-like electrode 100 included in the orthogonal accelerator section 1.

The method of ionization in the ion source 4 is not specifically limited. For example, atmospheric ionization methods (such as electrospray ionization (ESI) or atmospheric pressure chemical ionization (APCI)) can be used for liquid samples, while matrix-assisted laser desorption/ionization (MALDI) can be used for solid samples.

A basic analyzing operation in the present orthogonal acceleration TOFMS is as follows: Various kinds of ions generated in the ion source 4 are introduced through the ion transport optical system 5 into the orthogonal accelerator section 1. During the process of introducing the ions into the orthogonal accelerator section 1, the acceleration voltage is not applied to the electrodes 11 and 100 in the orthogonal accelerator section 1. After an adequate amount of ions have been introduced, predetermined voltages are respectively applied from the orthogonal acceleration power source 6 to the push-out electrode 11 and the grid-like electrode 100 to create an accelerating electric field. Due to the effect of this field, an amount of kinetic energy is imparted to the ions to make them pass through the openings of the grid-like electrode 100 and enter the flight space in the TOF mass separator 2.

As shown in FIG. 2, the ions which have begun their flight from the accelerating region in the orthogonal accelerator section 1 are made to reverse their direction by the electric field created by the reflectron 24, to eventually arrive at the detector 3. The detector 3 produces detection signals corresponding to the amount of ions which have arrived at the detector 3. A data processor (not shown) calculates a time-of-flight spectrum from the detection signals, and furthermore, converts the times of flight into mass-to-charge ratios to obtain a mass spectrum.

A major characteristic of the orthogonal acceleration TOFMS of the present embodiment lies in the structure of the grid-like electrode 100 provided in the orthogonal accelerator section 1 and in the procedure of manufacturing that electrode.

Figure 3:
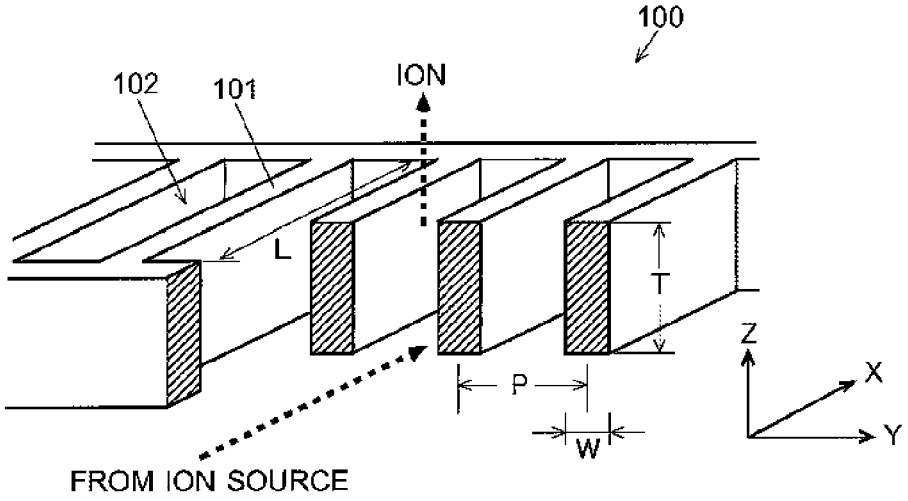
FIG. 3 is a partially-sectioned perspective view of the grid-like electrode in the present embodiment.

FIG. 1(*c*) is an external perspective view of the grid-like electrode 100, and FIG. 3 is a partially-sectioned perspective view of the same electrode 100. The grid-like electrode 100 used in the TOFMS of the present embodiment has crosspieces 101 with a rectangular cross section, which are arranged at intervals of P=100 μm. Each crosspiece 101 has a width of W=20 μm and a thickness of T=3 mm. Each of the openings 102 formed between the two neighboring crosspieces 101 has a length of L=30 mm and a width of 80 μm.

The procedure (process) of manufacturing the grid-like electrode 100 is hereinafter described by means of FIG. 1. As shown in FIG. 1(*a*), a thin metal plate 113 with a thickness of 20 μm (which corresponds to the electrically conductive thin plate in the present invention) and metal members 112 consisting of two 80-μm-thick prismatic bars aligned parallel to each other (which correspond to the electrically conductive spacer members in the present invention) are alternately stacked to form a multilayer structure, which is sandwiched between two thick metal plates 111 with a thickness of a few millimeters. The metal members 112 and the thin metal plates 113 are bonded together, and so are the metal members 112 and the thick metal plates 111, to combine them into an integrated body. The reason for using the thicker metal plates 111 at both ends is to make the entire structure sufficiently strong. The thick metal plates 111, the metal members 112 and the thin metal plates 113 are all made of stainless steel, although this is not the only choice of materials.

The method for bonding the metallic parts is not specifically limited. However, the bonding must satisfy the requirement that none of the plate members undergo a significant deformation and that a sufficient electric contact (low electric resistance) is ensured between the members. A bonding method suitable for satisfying those requirements is the diffusion boding. The diffusion bonding method is a technique for bonding two members using atomic diffusion which is made to occur at the bond surfaces by making the members to be bonded in tight contact with each other in a clean state and heating them in vacuum atmosphere or inert-gas atmosphere under a temperature condition not higher than the melting points of the members as well as under a pressure that does not cause significant plastic deformation of the members.

With diffusion bonding, not only the same kind of metal (as in the present example) but also different kinds of metal can easily be bonded.

The metal members 112 sandwiched between the two neighboring thin metal plates 113 or between the thin metal plate 113 and the thick metal plate 111 function as the spacers. Therefore, when the thin metal plates 113, the metal members 112 and the thick metal plates 111 are entirely bonded together, a multilayer body 110 in the form of a metal block having a large number of extremely thin rectangular-parallelepiped gaps formed inside is obtained, as shown in FIG. 1(*b*). Subsequently, this multilayer body 110 is cut at planes which are orthogonal to the thin metal plates 113 (i.e. orthogonal to the X-Z plane) and which are located at predetermined intervals (e.g. at the positions indicated by the broken lines 114 or the chained lines 115 in FIG. 1(*b*)). In this cutting process, the wire electric discharge method can suitably be used so as to minimize the force acting on the members (and hence minimize the deformation of the members) and to prevent the formation of large buns so that the cleanest possible cut surfaces will be obtained.

By slicing the multilayer body 110, for example, at the positions indicated by the broken lines 114 in the previously described manner, a grid-like electrode 100 as shown in FIG. 1(*c*) is completed, in which the thin metal plates 113 serving as the crosspieces 101 and the metal members 112 serving as the spacers which define the gaps serving as the openings 102 are sandwiched between the rigid frames 103. If the multilayer body 110 is sliced at the positions indicated by the chained lines 115, a grid-like electrode having slightly longer openings whose width is the same as shown in FIG. 1(*c*) is formed. Although the previously described manufacturing method requires a certain amount of expense for creating the multilayer body 110, the unit price per one grid-like electrode 100 can be decreased since a large number of grid-like electrodes 100 can be obtained from one multilayer body 110. Accordingly, the method is not inferior to the electroforming or other conventional methods in terms of the cost.

Figure 14:
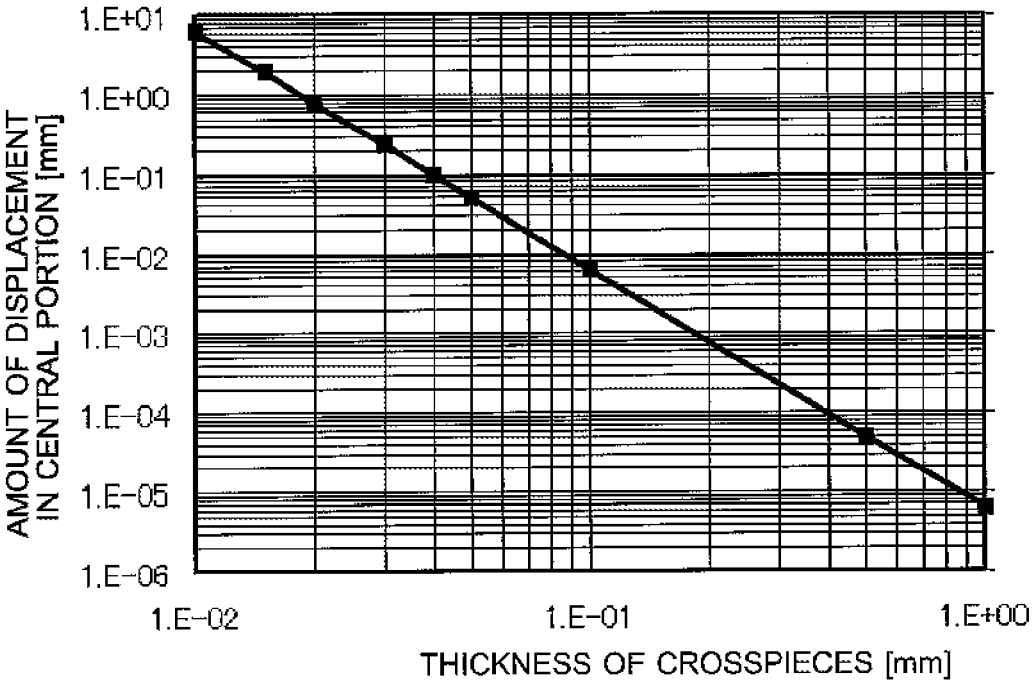
FIG. 14 shows the result of a calculation of a predicted amount of displacement in a central portion of a crosspiece of a grid-like electrode for various thicknesses T of the crosspiece.

According to the relationship between the thickness T of the crosspieces and the predicted amount of displacement in the central portion shown in FIG. 14, if the crosspieces 101 have a thickness of T=3 mm, the amount of displacement will be much smaller than in the case of the conventional thickness of approximately 10 μm. That is to say, the grid-like electrode 100 in the present embodiment is dramatically stronger than the conventional ones.

Figure 4:
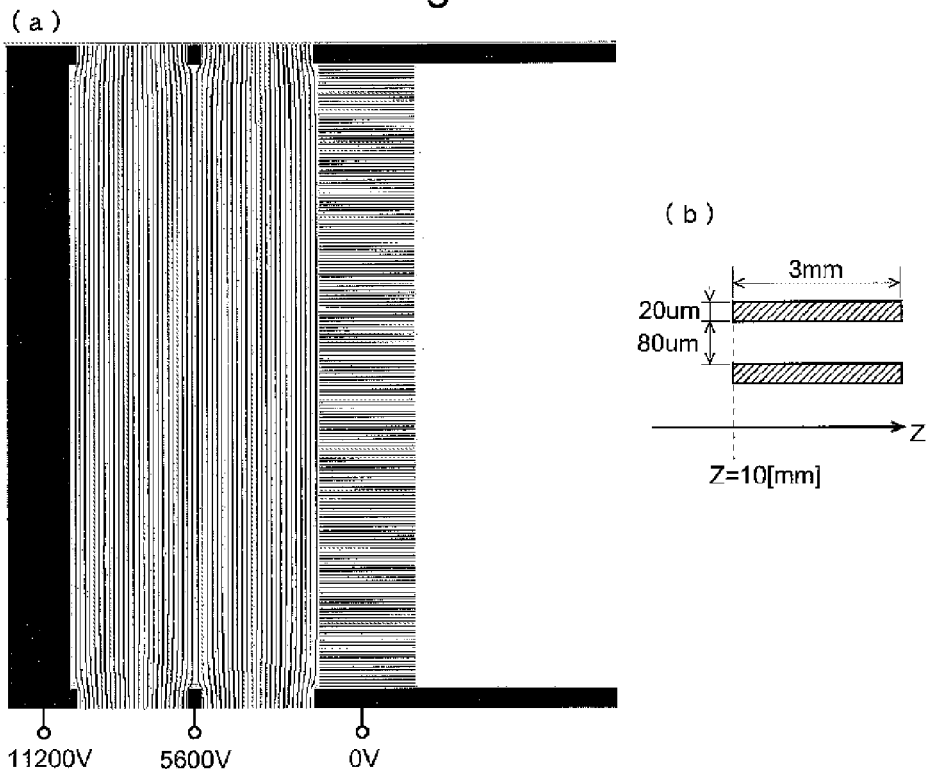
FIG. 4 shows an electrode shape used in a calculation of an axial potential of the grid-like electrode in the present embodiment.
Figure 5:
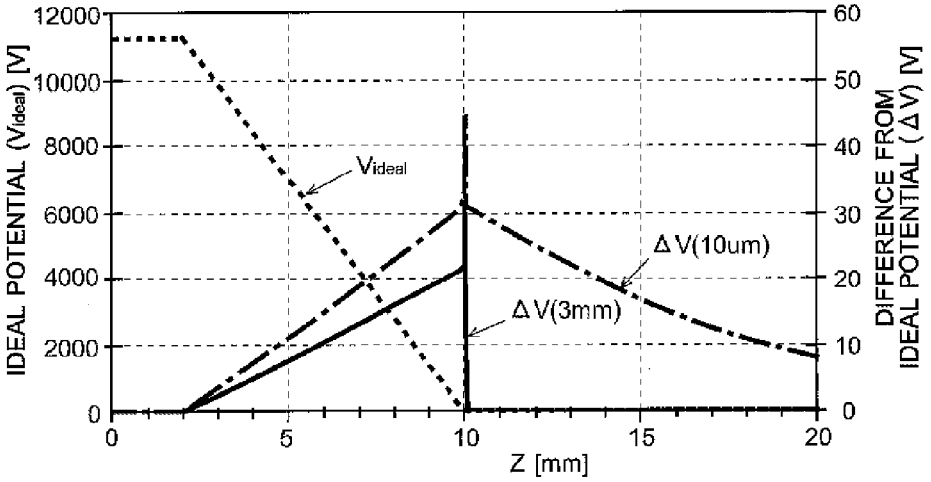
FIG. 5 shows the result of a calculation of the axial potential of the grid-like electrode with the configuration shown in FIG. 4.

The grid-like electrode 100 having such a high aspect ratio has not only high mechanical strength but also other advantages. FIG. 5 shows the result of a calculation of a potential distribution in two grid-like electrodes having the crosspiece thicknesses of 10 μm and 3 mm, respectively, under the condition that the electrode shape (having planar symmetry in the direction perpendicular to the drawing sheet) and the applied voltages are as shown in FIG. 4. The ideal potential (Videal) in FIG. 5 corresponds to the state in which an electric field of 1400 V/mm is created within the orthogonal accelerator section 1 (Z<10 mm) while the potential in the region behind the grid-like electrode 100 located on the exit side (Z>10 mm) is 0 V. For each of the two grid-like electrodes having the aforementioned thicknesses, the potential distribution formed along the central axis was calculated and the discrepancy (difference) ΔV of the axial potential from the ideal potential was computed.

As can be seen in FIG. 5, in the case of the grid-like electrode with a thickness of 10 μm (which is a conventional grid-like electrode manufactured by electroforming or other processes), the electric field penetrates to a considerable extent beyond the boundary of the grid-like electrode (i.e. through the openings) and causes a significant potential discrepancy over a considerable distance in Z>10 mm. Such a potential discrepancy causes a deviation of the focusing characteristics of the mass spectrometer from the theory, which leads to a deterioration of the device performance. By contrast, in the case of the 3-mm-thick grid-like electrode used in the orthogonal acceleration TOFMS of the present embodiment, the penetration of the electric field is barely observable in Z>10 mm and the potential discrepancy is virtually zero. Thus, one of the factors which disturb the theoretically calculated focusing condition can be eliminated.

Figure 6:
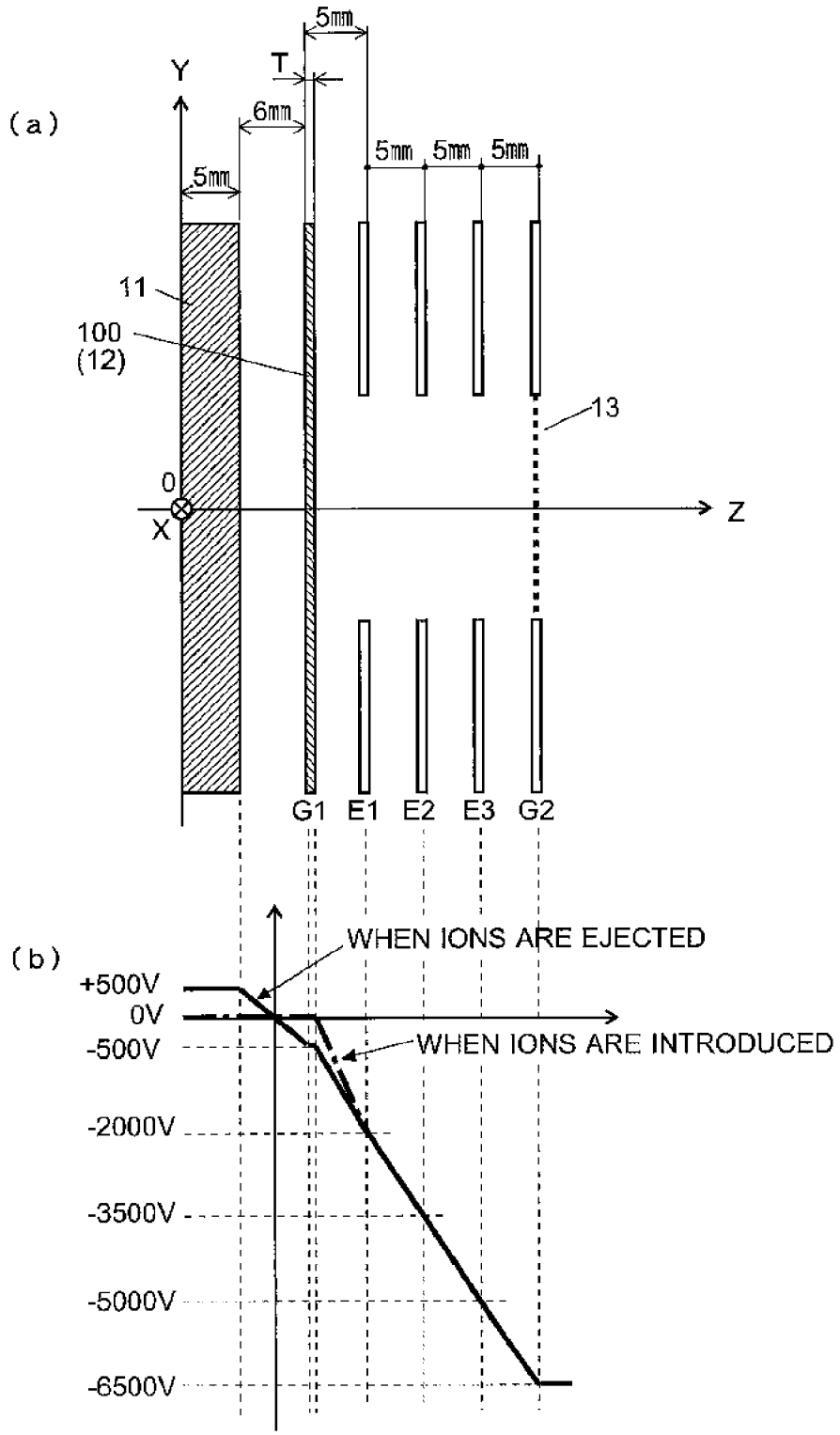
FIG. 6 shows an electrode arrangement and an axial potential used in an axial potential calculation in the case where two grid-like electrodes are provided.
Figure 11:
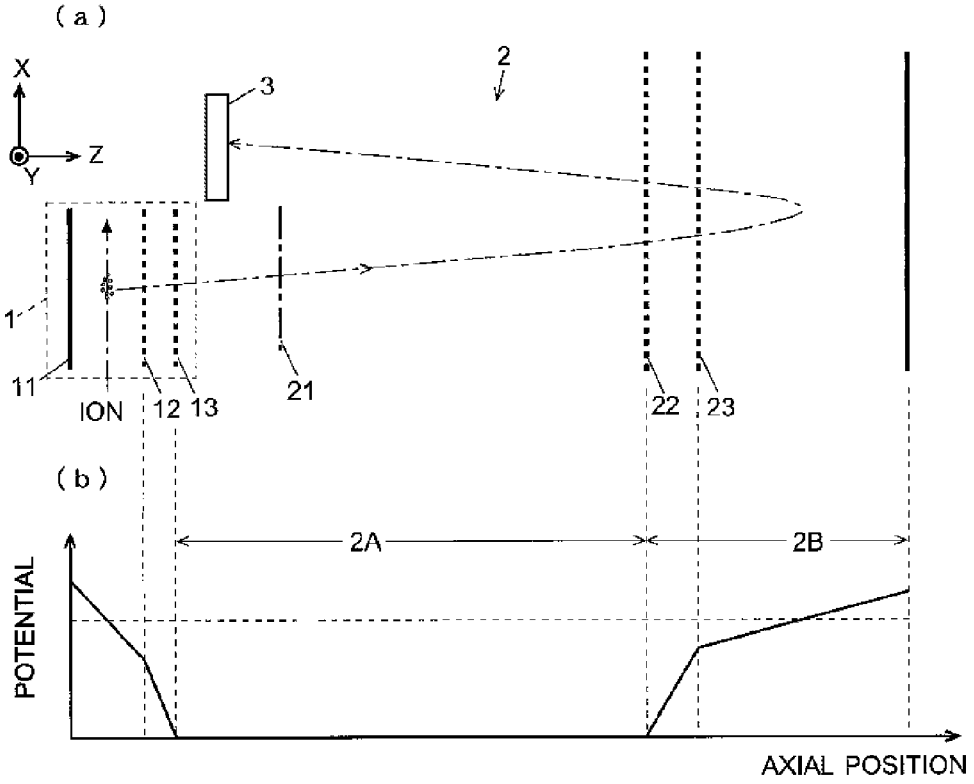
FIG. 11 shows (a) a schematic configuration diagram of a typical orthogonal acceleration TOFMS, and (b) a potential distribution diagram on the central axis of the ion flight.
Figure 12:
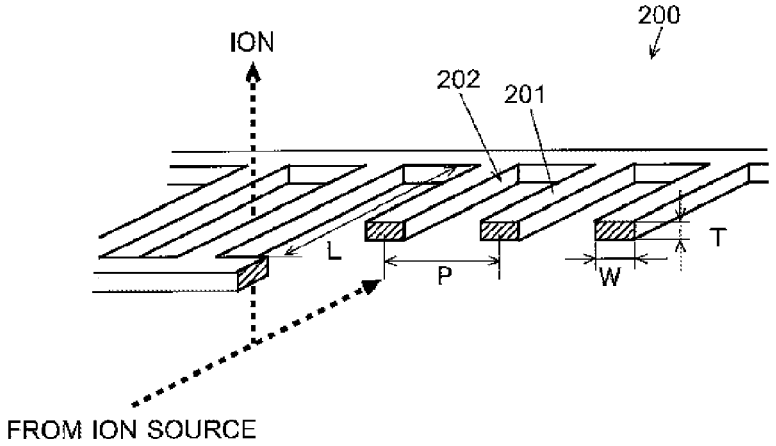
FIG. 12 is a partially-sectioned perspective view of one example of conventional grid-like electrodes.
Figure 13:
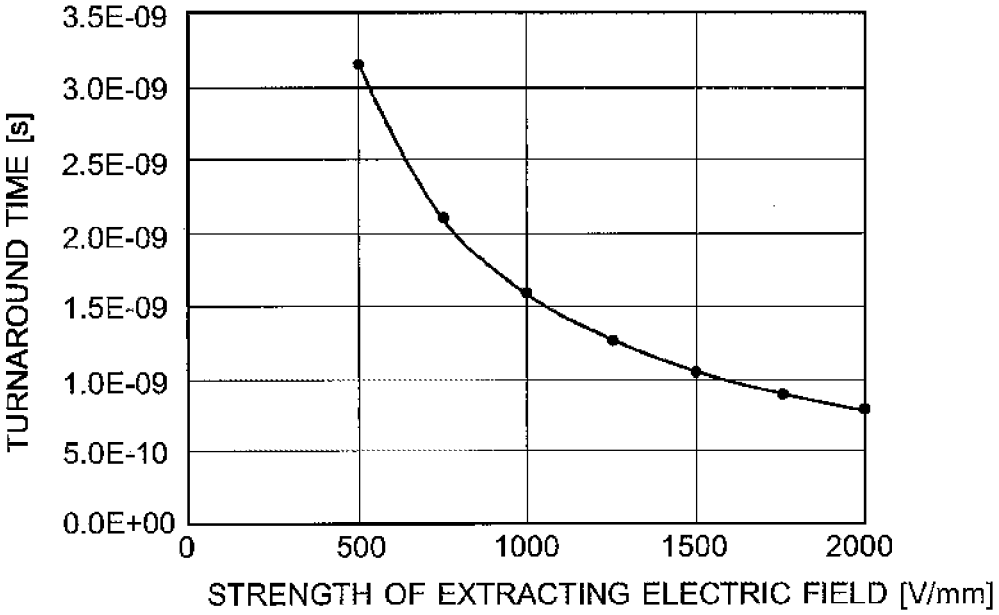
FIG. 13 shows one example of the result of a calculation of a relationship between the strength of the extracting electric field and the turnaround time $T_A$.

Hereinafter described is the result of a study conducted to investigate the relationship between the penetration of the electric field through the openings of the grid-like electrode and the thickness of the same electrode in the case where the orthogonal accelerator section has two grid-like electrodes, as shown in FIG. 11, and a dual-stage ion-accelerating region is created in the ion-ejecting process. FIG. 6(*a*) shows the electrode arrangement in the orthogonal accelerator section 1 investigated in the present case, and FIG. 6(*b*) shows the potential distribution formed in the ion-introducing process and that formed in the ion-ejecting process.

As shown in FIG. 6(*a*), three electrodes are arranged along the Z-axis, i.e. the push-out electrode 11 placed within a range of 0≤Z≤5 mm, the first grid-like electrode (G1) 100 (which corresponds to the grid-like electrode 12 in FIG. 11(*a*)) placed within a range of 11≤Z≤(11+T) mm, and the second grid-like electrode (G2) 13 placed at Z=31 mm. That is to say, the range of 5≤Z≤11 mm which corresponds to the first accelerating region, and the range of (11+T)≤Z≤31 mm which corresponds to the second accelerating region, are provided along the Z-axis. The grid-like electrode 100 has a grid width of W=20 μm, a grid interval of P=100 μm, an opening width of P-W=80 μm, and a grid thickness of T mm.

The simulation was performed under the following conditions: The grid-like electrode 100 has the shape as shown in FIG. 6(*a*) (having planar symmetry in the direction perpendicular to the drawing sheet). Both the push-out electrode 11 and the grid-like electrode 100 are maintained at a potential of 0 V when ions are being introduced into the first accelerating region along the X-axis (to charge this region). After a sufficient amount of ions have been introduced, a positive voltage (+500 V) and a negative voltage (−500 V) are respectively applied to the push-out electrode 11 and the grid-like electrode 100 to create a direct-current electric field within the first accelerating region and accelerate positive ions in the positive direction of the Z-axis.

Figure 7:
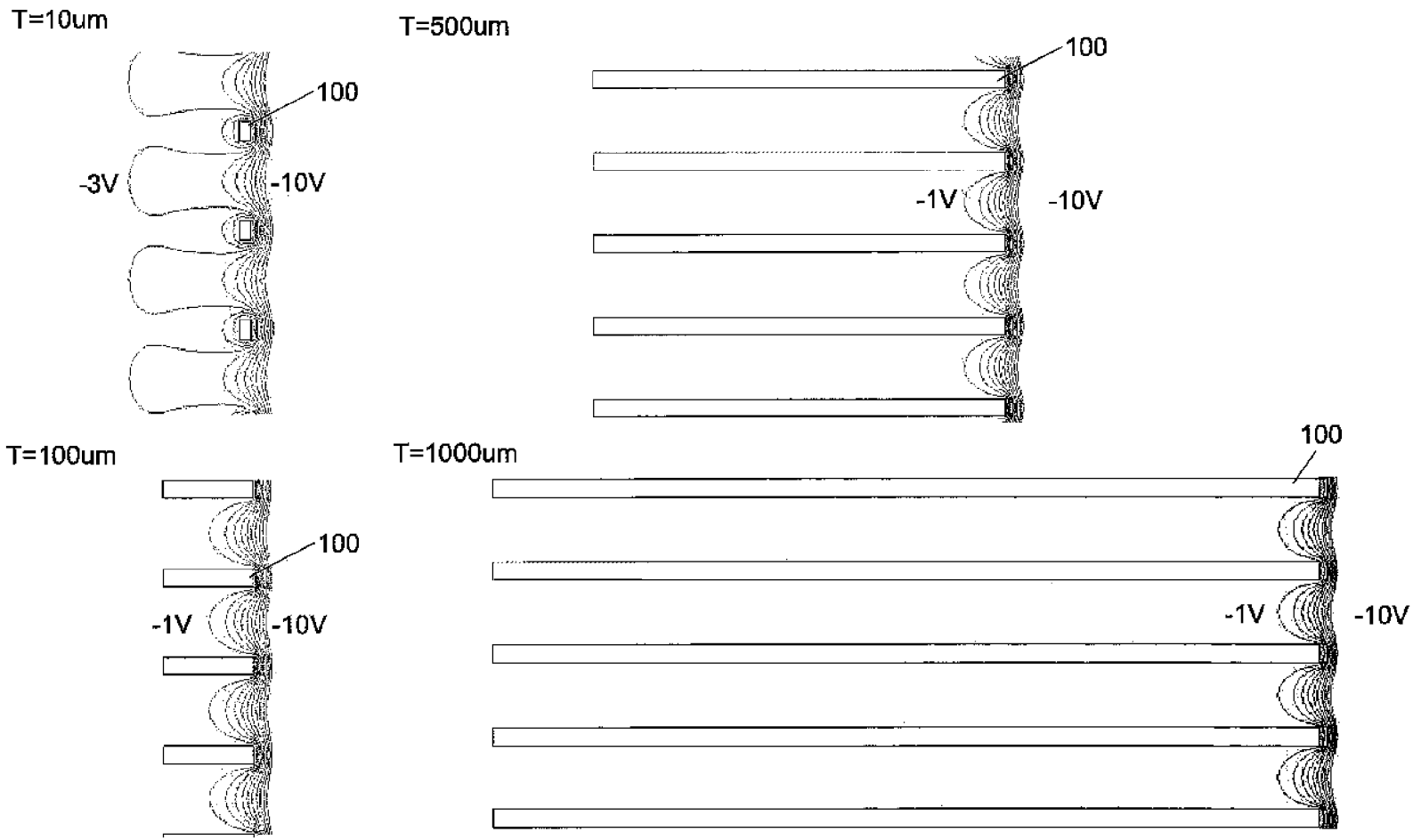
FIG. 7 shows the result of a simulation of a potential distribution in the process of introducing ions under the condition shown in FIG. 6.

The result of the simulation of the potential distribution during the ion-introducing process (i.e. when both the push-out electrode 11 and the grid-like electrode 100 are at 0 V) is shown in FIG. 7. In FIG. 7, the equipotential surfaces formed by the penetrating electric field are represented by contour lines at intervals of 1 V within a range from −1 V to −10 V. The calculation was performed for the following four different thicknesses T of the grid-like electrode 100: 10 μm (conventional level), 100 μm (approximately equal to the size of the smaller dimension (width) D of the rectangular openings in the grid), 500 μm (approximately 5D) and 1000 μm (approximately 10D). FIG. 7 shows that, when T=10 μm, the electric field significantly penetrates through the openings of the grid-like electrode 100 into the space on the other side, and that the extent of the penetration of the electric field decreases as the thickness of the grid-like electrode 100 increases.

Figure 8:
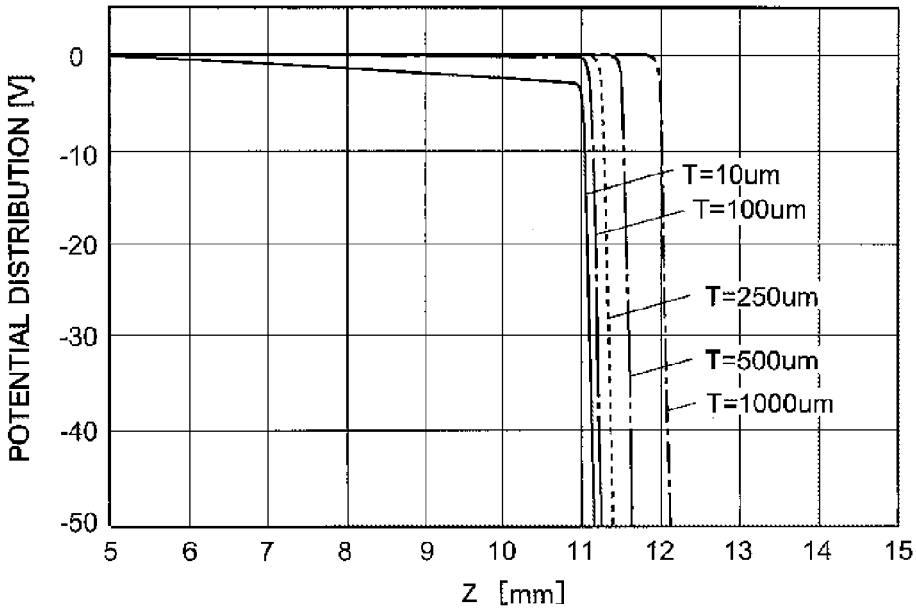
FIG. 8 shows the result of a calculation of an axial potential distribution in the grid-like electrode under the condition shown in FIG. 6.
Figure 8:
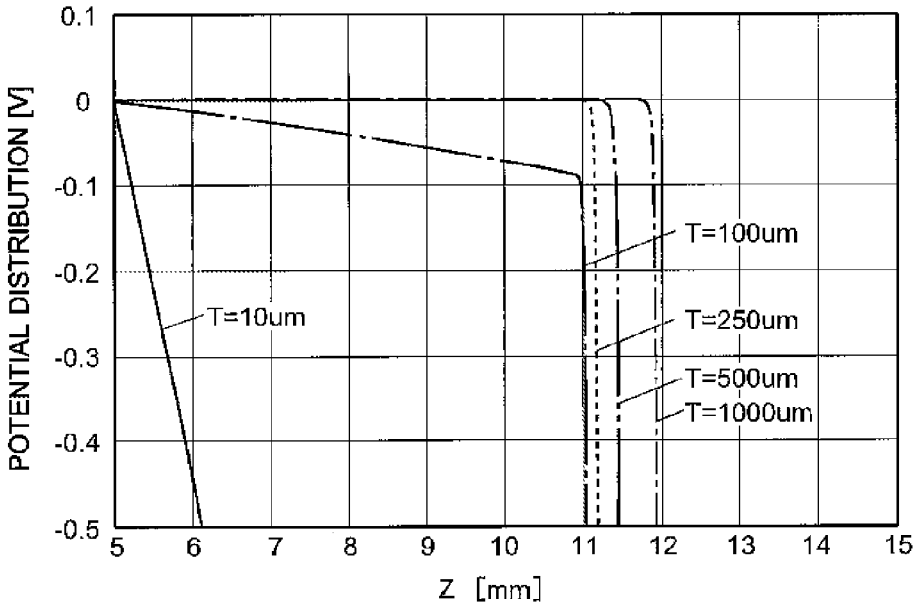

FIG. 8 shows the result of a calculation of the potential on the Z-axis, where (b) shows a portion of (a) in a vertically enlarged form. When T=10 μm, the penetration of the electric field is large and the magnitude of the potential due to that electric field reaches a maximum level of a few volts. Due to the effect of this electric field, the ions introduced into the first accelerating region along the X-axis direction are deflected in the Z-axis direction, with their trajectories curved. As a result, the mass-resolving power is expected to deteriorate. When T=100 μm, the magnitude of the potential due to the penetrating electric field is significantly smaller than when T=10 μm. However, the potential still reaches a maximal level of approximately 100 mV. This level is higher than the energy of thermal motion of the ions at room temperature, which is approximately 30 meV. Therefore, when T=100 μm, the ions probably flow into the field-free flight space during the ion-introducing process.

By contrast, when T=250 μm, i.e. when the thickness of the grid (or crosspieces 101) is approximately 2.5 times the width of the openings, the potential due to the penetrating electric field is less than 10 mV, which is adequately lower than the energy of thermal motion of the ions at room temperature. Accordingly, the penetrating electric field cannot powerfully accelerate the ions and make them leak into the field-free flight space. The potential due to the penetrating electric field can be presumed to almost linearly change between T=100 μm and T=250 μm. Therefore, from the previously described results, it can be said that, if the thickness of the grid is equal to or larger than two times the width of the openings, the potential due to the penetrating electric field will assuredly be lower than the energy of thermal motion of the ions at room temperature, so that neither the leakage of the ions nor the curving of their trajectories in the ion-introducing process will occur.

One possible disadvantage resulting from the increase in the thickness of the crosspieces 101 of the grid-like electrode 100 is that the annihilation of the ions (and the decrease in the ion transmission efficiency) due to collision with the wall surface of the crosspieces 101 is more likely to occur when the ions pass through the openings 102. The annihilation of the ions does not occur if the incident direction of the ions is orthogonal to the incident plane of the grid-like electrode 100 (i.e. if the travelling direction of the ions is parallel to the thickness direction of the crosspieces 101). However, the problem becomes noticeable as the incident directions (incident angles) of the ions become more spread. In the case where the ions are accelerated in the orthogonal direction by using the push-out electrode 11 and the grid-like electrode 100 as in the time-of-flight mass spectrometer of the present embodiment, the ions are ejected in comparatively uniform directions and enter the grid-like electrode 100 with only a small spread of incident angles. Therefore, the loss of the ions remains small even if the thickness of the crosspieces 101 is increased.

Thus, in the orthogonal TOFMS of the present embodiment, as shown in FIGS. 2 and 3, ions are injected into the orthogonal accelerator section 1 in such a manner that the ions form a beam which is as parallel to the X-axis as possible. The grid-like electrode 100 is placed so that the longer sides of its openings 102 lie parallel to the X-axis. Accordingly, immediately before the ions are accelerated in the orthogonal accelerator section 1, the ion packet is moving in the same direction as the longer dimension of the openings 102 of the grid-like electrode 100. In this situation, the ions have only small initial-velocity components in the Z-axis direction, which means that their turnaround time in the accelerating process is short and the temporal dispersion of the ion packet due to the turnaround time is accordingly small. Therefore, a high mass-resolving power is achieved. The initial-velocity components in the Y-axis direction of the ions are also small, so that the ions can pass through the openings 102 with only a minor loss of ions even if the grid-like electrode 100 having the previously described structure is used.

As one example, an allowable initial energy in the Y-axis direction is hereinafter estimated for a crosspiece 101 with a thickness of T=3 mm, a width of W=20 μm and an interval of P=100 μm. An allowable angular spread θ at the moment of incidence to the grid-like electrode 100 is geometrically given by the following equation (2):

$$\theta=\tan^{-1}(0.04/3)=0.7639 \text{ degrees} \quad (2)$$

On the other hand, if an ion is accelerated to Ez=5600 eV before entering the grid-like electrode 100, its angular spread is:

$$\theta=\tan^{-1}\sqrt{Ey/Ez} \quad (3)$$

From equations (2) and (3), the allowable initial energy in the Y-axis direction is found to be 0.996 eV. This is a sufficiently large value for an orthogonal acceleration TOFMS in which the initial energies in the Y and Z axis directions can be decreased to the level of the energy of thermal motion (30 meV). Thus, it is possible to conclude that, even if the grid-like electrode 100 having the previously described characteristic structure is used in the orthogonal accelerator section 1 of the orthogonal acceleration TOFMS according to the present embodiment, the resultant decrease in the ion transmission efficiency will remain small, so that the improved mass-resolving power can be fully exploited.

Figure 9:
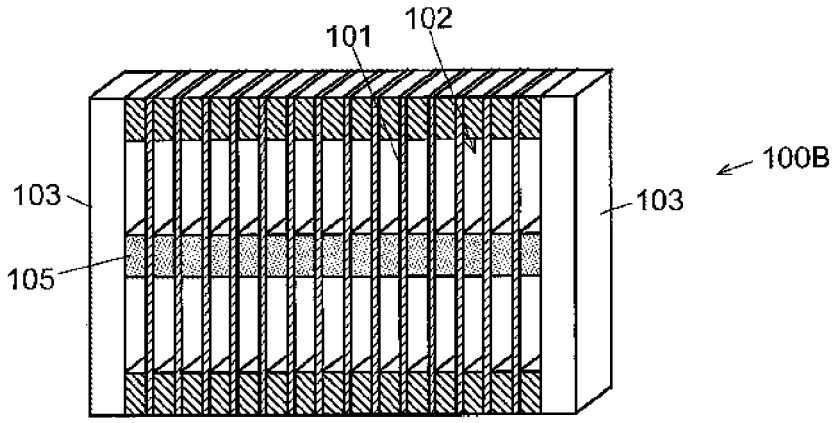
FIG. 9 is an external perspective view of a grid-like electrode in another embodiment.

FIG. 9 is a perspective view showing a grid-like electrode 100B which is one variation of the previously described grid-like electrode 100. In this variation, a metal member serving as a spacer is additionally used in the manufacturing process to provide a holding portion 105 for holding the crosspieces 101 in the middle of the elongated openings 102. Naturally, the addition of the holding portion 105 not only increases the mechanical strength but also decreases the ion transmission efficiency. Therefore, it is necessary to determine the shape and number of each member while considering the trade-off between the mechanical strength and the ion transmission efficiency. For example, it is possible to increase the number of holding portions 105 so as to improve the mechanical strength while somewhat sacrificing the ion transmission efficiency. In summary, the grid-like electrode used in the system according to the present invention may have any structure as long as it has N×M openings arrayed in the form of a matrix (where N is a positive integer while M is a somewhat large integer). For example, N=1 and M=15 in the case of the grid-like electrode 100 shown in FIG. 1(*c*), and N=2 and M=15 in the case of the grid-like electrode 100B shown in FIG. 9. The value of N may be as large as M.

Figure 10:
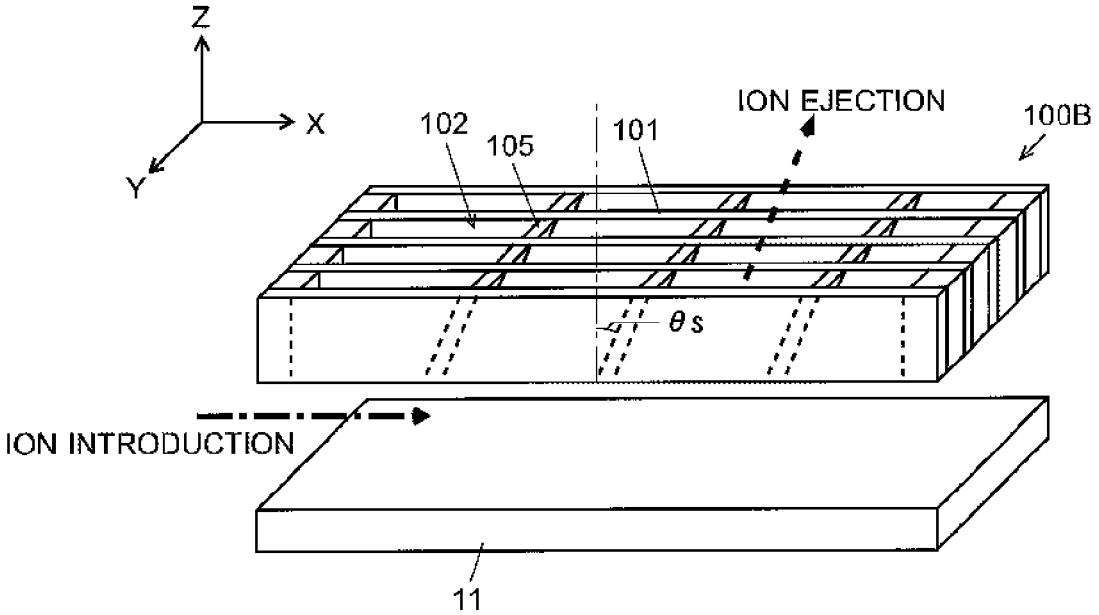
FIG. 10 is an external perspective view of a grid-like electrode in another embodiment.

For a further improvement, the holding portions 105 in the grid-like electrodes 100B shown in FIG. 9 may be oriented in the traveling direction of the ion packet to minimize the amount of ions to be annihilated due to collision with the holding portions 105. That is to say, as shown in FIG. 10, the holding portions 105 can be inclined from the line orthogonal to the ion incident plane of the grid-like electrode 100 by θs, which equals the inclination angle of the ion packet. The inclination angle θs of the ion packet is given by:

$$\theta s=\tan^{-1}\sqrt{Ex/Ez} \quad (4)$$

where Ex is the initial energy of the ions in the X-axis direction and Ez is the acceleration energy in the Z-axis direction of the ions in passing through the grid-like electrode 100. θs is a fundamental value obtained when the ion optical system is designed. Therefore, it is easy to obtain a grid-like electrode 100B having the configuration as shown in FIG. 10.

As can be understood from FIG. 1, if members having a small size in the Z-axis direction (e.g. 3 mm) are used from the start as the thin metal plates 113, the metal members 112 and the thick metal plates 111, the desired grid-like electrode 100 can be obtained by performing only the stacking process (such as the diffusion bonding) and without the subsequent cutting process.

In the previous embodiment, the grid-like electrode having the previously described characteristic configuration is used to create the accelerating electric field in the orthogonal accelerator section 1. This grid-like electrode can also be used, for example, at a position in the flight space where it is necessary to create an accelerating or decelerating electric field while allowing ions to pass through. That is to say, the grid-like electrode 100 or 100B can also be used in place of the grid-like electrode 22 or 23 in FIG. 11.

It should be noted that the previous embodiment is a mere example of the present invention, and any change, modification or addition appropriately made within the spirit of the present invention will naturally fall within the scope of claims of the present patent application.

EXPLANATION OF NUMERALS

1 . . . Orthogonal Accelerator Section
11 . . . Push-out Electrode
100, 100B . . . Grid-Like Electrode
101 . . . Crosspiece
102 . . . Opening
103 . . . Frame
105 . . . Holding Portion
110 . . . Multilayer Body
111 . . . Thick Metal Plate
112 . . . Metal Member
113 . . . Thin Metal Plate
114 . . . Broken Line (Cutting Line)
115 . . . Chained Line (Cutting Line)
2 . . . TOF Mass Spectrometer
24 . . . Reflectron
3 . . . Detector
4 . . . Ion Source
5 . . . Ion Transport Optical System
6 . . . Orthogonal Acceleration Power Source

The invention claimed is:

1. A time-of-flight mass spectrometer in which ions are accelerated and introduced into a flight space, and in which the ions are detected after being separated according to their mass-to-charge ratios while flying in the flight space, the time-of-flight mass spectrometer having a grid-like electrode for creating an electric field for accelerating and/or decelerating the ions while allowing the ions to pass through, wherein:

the grid-like electrode is a structure having a thickness equal to or greater than two times a size of a smaller dimension of an opening of the grid-like electrode, the thickness being a dimension along the travelling direction of the ions passing through the opening.

2. The time-of-flight mass spectrometer according to claim 1, wherein:

an orthogonal accelerator section for initially accelerating ions is provided, the orthogonal accelerator section including a push-out electrode, a first grid-like electrode consisting of the aforementioned grid-like electrode, and a second grid-like electrode placed on an opposite side of the first grid-like electrode from the push-out electrode, and the three electrodes being arranged so that ions sequentially pass through the first and second grid-like electrodes to be ejected from the orthogonal accelerator section into the flight space.

3. The time-of-flight mass spectrometer according to claim 1, wherein the grid-like electrode is a grid-like structure created by stacking a plurality of electrically conductive thin plates, with electrically conductive spacer members placed in between, to form an integrated body and by cutting this body at each of a plurality of planes orthogonal to the electrically conductive thin plates and arranged at predetermined intervals, the grid-like structure having openings whose width corresponds to a thickness of the electrically conductive spacer members and crosspieces whose width corresponds to a thickness of the electrically conductive thin plates, the crosspieces having a thickness corresponding to the interval of the cutting.

4. The time-of-flight mass spectrometer according to claim 3, wherein the integrated body is formed by diffusion bonding.

5. The time-of-flight mass spectrometer according to claim 1, the grid-like electrode is a grid-like structure created by stacking a plurality of electrically conductive thin plates, with electrically conductive spacer members placed in between, to form an integrated body, the grid-like structure having openings whose width corresponds to the thickness of the electrically conductive spacer members and crosspieces whose width corresponds to the thickness of the electrically conductive thin plates, the crosspieces having a thickness corresponding to a size of one side of the electrically conductive thin plates.

6. The time-of-flight mass spectrometer according to claim 1, wherein the grid-like electrode has a holding portion comprising an electrically conductive spacer member partitioning the opening of the grid-like electrode into sections along a larger dimension of the opening, the electrically conductive spacer member being sandwiched between the electrically conductive thin plates.

7. The time-of-flight mass spectrometer according to claim 6, wherein the holding portion has a plate shape extending along the travelling direction of the ions passing through the opening.

8. A time-of-flight mass spectrometer in which ions are accelerated and introduced into a flight space, and in which the ions are detected after being separated according to their mass-to-charge ratios while flying in the flight space, the time-of-flight mass spectrometer having a grid-like electrode for creating an electric field for accelerating and/or decelerating the ions while allowing the ions to pass through, wherein:

the grid-like electrode is a grid-like structure created by stacking a plurality of electrically conductive thin plates, with electrically conductive spacer members placed in between, to form an integrated body and by cutting this body at each of a plurality of planes orthogonal to the electrically conductive thin plates and arranged at predetermined intervals, the grid-like structure having openings whose width corresponds to a thickness of the electrically conductive spacer members and crosspieces whose width corresponds to a thickness of the electrically conductive thin plates, the crosspieces having a thickness corresponding to the interval of the cutting.

9. The time-of-flight mass spectrometer according to claim 8, wherein:

the electrically conductive thin plate and the electrically conductive spacer members are combined into an integrated body by diffusion bonding.

10. The time-of-flight mass spectrometer according to claim 9, wherein:

the grid-like electrode has a holding portion comprising an electrically conductive spacer member partitioning the opening of the grid-like electrode into sections along a larger dimension of the opening, the electrically conductive spacer member being sandwiched between the electrically conductive thin plates, and the holding portion has a plate shape extending along the travelling direction of the ions passing through the opening.

11. The time-of-flight mass spectrometer according to claim 8, wherein:

an orthogonal accelerator section for initially accelerating ions is provided, the orthogonal accelerator section including a push-out electrode and the aforementioned grid-like electrode, the two electrodes being arranged so that ions pass through the grid-like electrode to be ejected from the orthogonal accelerator section into the flight space.

12. The time-of-flight mass spectrometer according to claim 11, wherein:

the grid-like electrode has a holding portion comprising an electrically conductive spacer member partitioning the opening of the grid-like electrode into sections along a larger dimension of the opening, the electrically conductive spacer member being sandwiched between the electrically conductive thin plates.

13. The time-of-flight mass spectrometer according to claim 12, wherein:

the holding portion has a plate shape extending along the travelling direction of the ions passing through the opening.

14. The time-of-flight mass spectrometer according to claim 8, wherein:

the grid-like electrode has a holding portion comprising an electrically conductive spacer member partitioning the opening of the grid-like electrode into sections along a larger dimension of the opening, the electrically conductive spacer member being sandwiched between the electrically conductive thin plates.

15. The time-of-flight mass spectrometer according to claim 14, wherein:

the holding portion has a plate shape extending along the travelling direction of the ions passing through the opening.

16. A time-of-flight mass spectrometer in which ions are accelerated and introduced into a flight space, and in which the ions are detected after being separated according to their mass-to-charge ratios while flying in the flight space, the time-of-flight mass spectrometer having a grid-like electrode for creating an electric field for accelerating and/or decelerating the ions while allowing the ions to pass through, wherein:

the grid-like electrode is a grid-like structure created by stacking a plurality of electrically conductive thin plates, with electrically conductive spacer members placed in between, to form an integrated body, the grid-like structure having openings whose width corresponds to the thickness of the electrically conductive spacer members and crosspieces whose width corresponds to the thickness of the electrically conductive thin plates, the crosspieces having a thickness corresponding to a size of one side of the electrically conductive thin plates.

17. The time-of-flight mass spectrometer according to claim 16, wherein:

the electrically conductive thin plate and the electrically conductive spacer members are combined into an integrated body by diffusion bonding.

18. The time-of-flight mass spectrometer according to claim 16 wherein:

an orthogonal accelerator section for initially accelerating ions is provided, the orthogonal accelerator section including a push-out electrode and the aforementioned grid-like electrode, the two electrodes being arranged so that ions pass through the grid-like electrode to be ejected from the orthogonal accelerator section into the flight space.

19. The time-of-flight mass spectrometer according to claim 16, wherein:

the grid-like electrode has a holding portion comprising an electrically conductive spacer member partitioning the opening of the grid-like electrode into sections along a larger dimension of the opening, the electrically conductive spacer member being sandwiched between the electrically conductive thin plates.

20. The time-of-flight mass spectrometer according to claim 19, wherein:

the holding portion has a plate shape extending along the travelling direction of the ions passing through the opening.

* * * * *